United States Patent [19]

Hisataka

[11] 4,446,576

[45] May 8, 1984

[54] SAFE GUARD PROTECTIVE EQUIPMENT FOR FIGHTING ART

[76] Inventor: Masauki Hisataka, 20, Kikui-cho, Shinjuku-ku, Tokyo, 162, Japan

[21] Appl. No.: 317,254

[22] Filed: Nov. 2, 1981

[30] Foreign Application Priority Data

Nov. 17, 1980 [JP] Japan ..... 55-165351

[51] Int. Cl.[3] ..... A42B 3/00

[52] U.S. Cl. ..... 2/425; 2/424; 2/412; 2/9

[58] Field of Search ..... 2/425, 424, 9, 10, 205, 2/412

[56] References Cited

U.S. PATENT DOCUMENTS 3,423,758 1/1969 Heacox ..... 2/424
4,058,854 11/1977 Rhee ..... 2/425 X
4,279,038 7/1981 Bruckner et al. ..... 2/425

FOREIGN PATENT DOCUMENTS 1034701 7/1978 Canada ..... 2/424

*Primary Examiner*—Peter P. Nerbun
*Attorney, Agent, or Firm*—Armstrong, Nikaido, Marmelstein & Kubovcik

[57] ABSTRACT

This invention relates to a safe guard protective equipment for fighting arts which protects the face and head of fighters in various fighting arts, and is constituted from a resilient cover body formed on the front with a viewing window for securing sufficient breathing and field of view for the wearer and covering the periphery of face and the sides of head and a protective mask secured fixedly to the front of the cover body to cover the viewing window, having a spherical viewing portion and formed of transparent anti-shock synthetic resin, and characterized in that the protective mask is individually provided in the lower half and the outer periphery of the viewing portion with vent holes and ventilating windows to exhaust the breathes of the wearer to the outside.

8 Claims, 5 Drawing Figures

SAFE GUARD PROTECTIVE EQUIPMENT FOR FIGHTING ART

BACKGROUND OF THE INVENTION (1) Field of the Invention

This invention relates to a safe guard protective equipment for the fighting arts which protects the face and head of a wearer from direct blows of an opponent in games and training of various fighting arts such as Karatedo, Taikando, Kanfu Kenpo, boxing, kendo, bayonet fencing, etc.

(2) Description of the Prior Art

Although in training and games of fighting arts safe guard protective equipment has been often worn for protecting faces and heads of fighters, there has been no protective equipment which can provide sufficient protection for the face of the fighter and also ensuring sufficient field of view of the fighter, and further be constructed to be manufactured with light weight so as not to interfere with the fighter's movement, and at low cost.

Particularly among said fighting arts, Karatedo is known for a Japanese traditional fighting art. It is characterized in that it is played traditionally without any protective equipment. Up to the present time there have been special circumstances in which the protective equipment is inhibited from being worn according to the rule of formal fight.

A main reason that the use of protective equipment is inhibited is because Karatedo's image is degraded by the use of various protective equipment in Karatedo which has been developed and succeeded as a Japanese fighting art in unarmed fights without any special arms, because quick attack and defence are hindered by the wearing of protective equipment, because various protective equipment proposed in the past was heavy and complicately constructed with poor safety, and high production cost.

However, in practice, it is an inevitable problem to employ safety preventive equipment in Karatedo for preventing Karateka' body from danger, for improving attack and defence technique and promoting progress of alert game in Karatedo by striking blows at opponent's vital parts freely as much as possible with discretion-free sufficient force, for clarifying the judgment of fights with the sound of the actual blow and for ensuring safety to spread Karatedo as a sport.

To overcome this problem, the following technique according to Japanse Pat. No. 792,798 (Patent Publication No. 3700/75) is known conventionally for the protective equipment for Karatedo.

The protective equipment shown in said patent specification and drawings has side covers for covering both sides of fighter's head and incorporating cushion material, the front upper and lower ends of said covers being interconnected through separate bands engaging the brow and chin respectively, the rear sides of said covers being interconnected detachably through a fastening band and further the front having both ends of a protective mask made of transparent plastic secured fixedly for covering the wearer's face and ensuring the field of view. While a large space is formed between the upper and lower ends of the protective mask and the wearer's face for vertical ventilation, another fastening string other than said fastening band is threaded through the upper ends of the side covers for fastening them when said covers are worn.

However, in said protective equipment, the joint of the jaw may be in particular injured since all shocks caused by the frontal blow given to the protective mask are transmitted only to the brow and chin through the upper and lower bands. Also, since the protective mask is fixedly attached only at the ends of both sides, it can not ensure strong frontal attacks so that it is not suited for a full-contact blow.

Also, between the upper and lower portions of the protective mask and the wearer's face are clearances to prevent the inner surface of the mask from fogging caused by perspiration and breathing. Since the wearer's breath abuts directly against the inner surface of the protective mask to condense water droplets thereon, said clearances have a disadvantage in that they cannot effectively prevent the fogging of the inner surface of the mask, i.e. the blockage of the field of view.

Further, said protective equipment has to be provided with special bands applied to the brow and chin to secure clearances for ventilation and provided on the upper portion with the fastening string in addition to the fastening band at the rear side for attaching said equipment to the head so that it is complicate in the construction, inconvenient to use, and costly in production.

SUMMARY OF THE INVENTION

A first object of the present invention is to provide a safe guard protective equipment for ensuring sufficiently a fighter's safety against an opponent's direct attach to the head and face in fighting arts.

A second object of the present invention is to provide a firm safe guard protective equipment which can endure hard full-contact with sufficient damping capacity and durability against the frontal attack of opponent.

A third object of the present invention is to provide a safe guard protective equipment to prevent the inner surface of the mask from fogging for securing always sufficient field of view of the wearer.

A fourth object of the present invention is to provide a safe guard protective equipment which is constructed to be simple, light and conveniently removably attached without interfering with the wearer's movement.

Other objects and features of the present invention will be apparent from detailed description of the present invention.

The above-mentioned and other objects are achieved by the following safe guard protective equipment for fighting arts.

Namely, according to the present invention, a resilient member for covering the periphery of the face containing the brow and head and the upper periphery, both sides and occiput of the head is continuously formed to constitute a cover body which is provided on the front with a viewing window for securing a sufficient field of view without blocking the wearer's breathing through the nose and mouth, and a protective mask made of a transparent anti-shock member covering said viewing window is mounted on the front of the cover body. Said protective mask protudes on the central portion toward the outside spherically and is provided on the periphery with a flange-shaped portion. The spherical viewing portion against which the wearer's breath is directed is provided with a plurality of vent holes while formed with thick wall and further provided on the outer periphery containing at least the upper or lower portion with ventilating windows.

BRIEF DESCRIPTION OF THE DRAWINGS

The nature, principle and detailes of the present invention will be more clearly apparent from the following detailed description of the preferred embodiment of the present invention with reference to the accompanying drawings, in which.

DETAILED DESCRIPTION OF THE PREFERRED EMBODIMENTS

Figure 1:
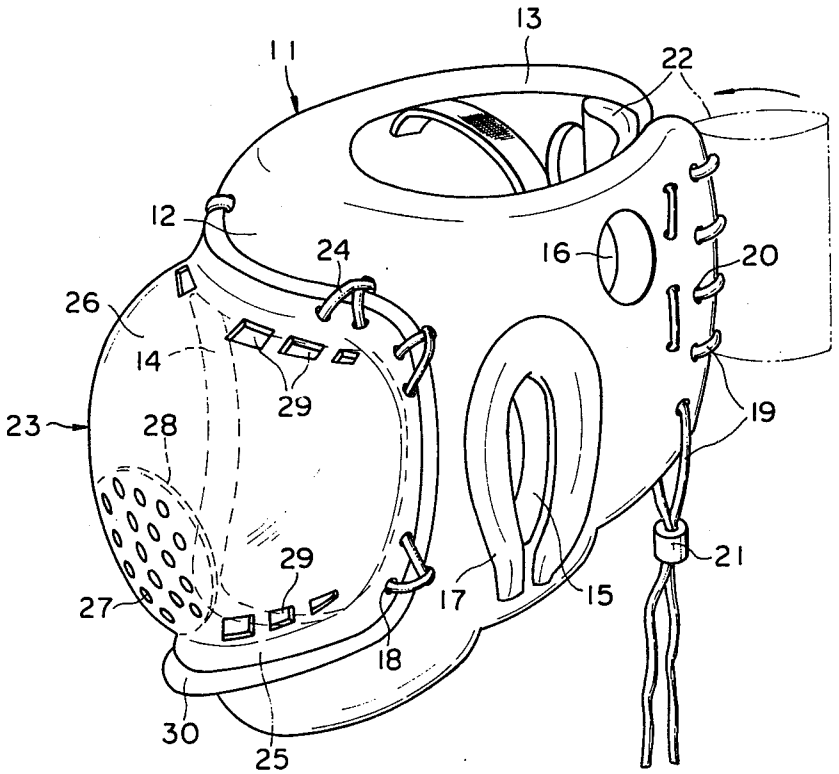
FIG. 1 is a perspective view showing the whole construction of an embodiment of a safe guard protective equipment for fighting arts according to the present invention.
Figure 2:
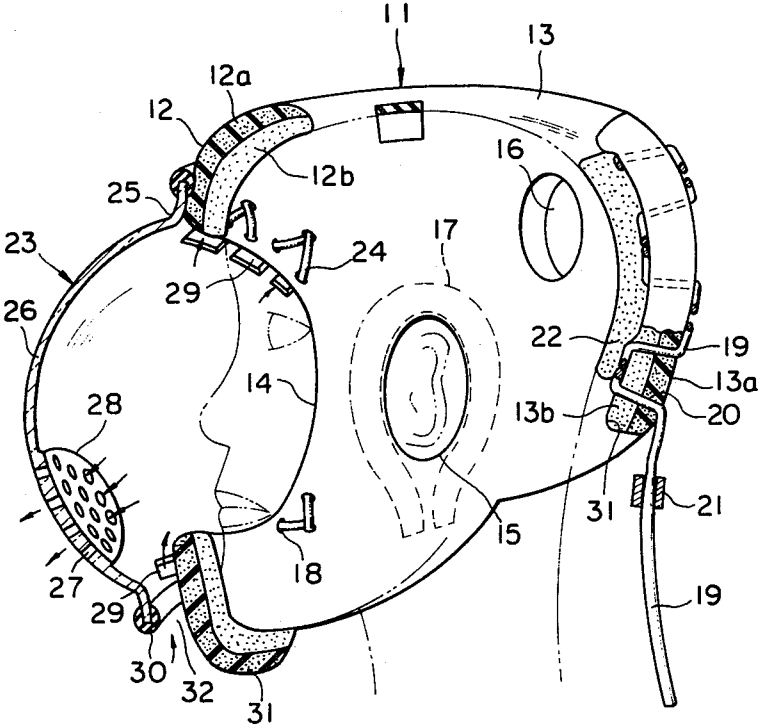
FIG. 2 is a sectional side elevation showing the side construction of the safe guard protective equipment according to the present invention.

FIG. 1 is a perspective view showing the whole construction of an embodiment of a sefe guard protective equipment according to the present invention. FIG. 2 is a sectional side elevation of same safe guard protective equipment. A cover body 11 is formed integrally with a front cover 12 covering the periphery of a face containing brow and chin of the wearer and side covers 13,13 covering the periphery of ears. In this embodiment, said cover body 11 is formed of a foam material made of special resilient spongy synthetic rubber of synthetic resin, and the perspective covers 12,13 are formed with a plurality of layers of armored members **12*a*,13*a* and lining members 12*b*,13*b* adhering to each other the armored members 12*a*,13*a* on the outer side of the covers being formed of a material having excellent shock resistance and relatively high hardness and the lining members 12*b*,13*b*** on the inner side of the covers being formed of a relatively soft material having high foaming magnification and high adaptability to the face and head.

The respective covers 12,13 have about 2–3 cm of a definite thickness, for example. The front cover 12 and the side cover 13 are integrally formed or separately formed and then bonded together by adhesives or the like to be bent for fitting respectively to the periphery of face and the head portion from the side to the rear portion.

Since, as mentioned above, the cover body 11 is of a double structure of hard and soft members, it has an excellent damping effect on shock, adaptability to the face and head and improved strength and durability. However, to reduce remarkably production cost, the body cover 11 may be integrally formed of a relatively hard and light material like styro-foam for example.

The front cover 12 is provided on the front with a viewing window 14 having sufficient size to secure a fighter wearing the protective equipment as wide a field of view as possible without interfering with the breathing through mouth and nose. The side covers 13 are respectively provided in an ear engaging portion with an ear window 15 cut out not to hinder the hearing of the wearer and with a proper number of vent holes 16 to prevent the interior of the worn protective equipment from being steamy.

A ear cover 17 formed of a cushion material bent C- or U-shaped along the outer periphery of said window 16 is mounted on said outer periphery by adhesion, sewing, etc. Said ear cover 17 is constructed to protect the ear from a sidewise blow while preventing the eardrum from accidents like a laceration and the like by releasing the internal air pressure in the instant of blow from the opened end of C- or U-shaped cover to the exterior.

Figure 3:
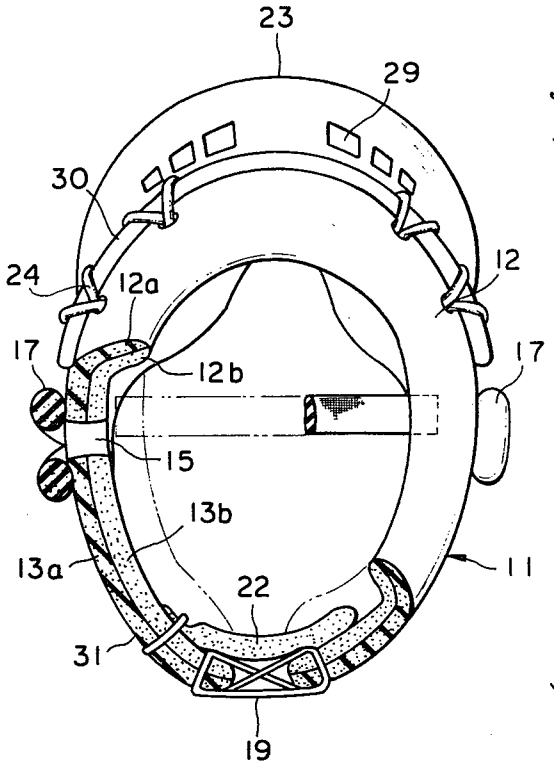
FIG. 3 is a partially sectional plan view of the upper end of the same safe guard protective equipment according to the present invention.

FIG. 3 is a partially sectional plan view showing the side of the upper end and a portion of the rear end of the safe guard protective equipment according to the present invention. The side cover 13 is provided in each rear end with a plurality of holes 20 arranged vertically. A string 19 is threaded through the holes 20 to fasten fixedly the body cover 11 to the head. Said string 19 is led alternatively to the rear ends of the side covers 13 at the opposite sides and the rear ends of the side covers 13,13 are pulled to each other by pulling both ends of the pendent string 19 to be fastened to the head. A ring-shaped clip 21 through which the both ends of the pendent string 19 are inserted is pushed up to fix the fastening condition of the string 19 while the both ends of the string 19 are pulled down.

A means for pulling together and fastening the rear ends of said side covers 13,13 is not limited to one of said string 19, but may be replaced by a well known lock band or fitting (not shown) for example.

Inside the rear end of one of the side covers 13,13 is secured fixedly one end of an occiput cover 22 inserted between the inside of the connected rear ends of said side covers 13,13 and the occiput of the wearer and incorporating a cushion material by sewing or adhesion, and the other end of said occiput cover 22 is free. This occiput cover 22 is a damping member for damping a shock when the wearer of the safe guard protective equipment falls flat on his back by the blow of opponent.

To the front of the front cover 12 is secured fixedly a protective mask 23 covering the whole viewing window 14 and formed of a hard transparent plastic material having excellent shock resistance (for example poly carbonate can be used). This protective mask 23 has shock resistance of at least 150 times that of conventional tempered glass, excellent transparency and surface luster without scattering broken pieces even if broken down.

Said protective mask 23 is constituted from a flange-shaped peripheral portion 25 conforming to the shape of the front cover 12 and a spherical viewing portion 26 constituting the central portion in said peripheral portion 25 to permit opponent's movement to be viewed without refraction from the interior of the cover body 11 through the viewing window 14. Said flange-shaped peripheral portion 25 and the corresponding periphery of the viewing window 14 in the front cover 12 are provided with a plurality of holes 18 through which a tough string 14 is threaded to secure fixedly the protective mask 23 to the cover body 11. In this fixed condition a clearance 32 for ventilation is formed between the lower central portion of the protective mask 23 and the lower end of the front cover 12.

Said spherical portion 26 of the protective mask 23 is provided in the lower half against which the breath from the wearer's mouth and nose abut with a plurality of small vent holes 27, and the portion provided with the holes 27 is formed with a thick wall portion 28 to prevent the degradation of shock resistance against the frontal attack. Also, ventilating windows 29 are provided in the upper and lower portions of the outer periphery of the spherical portion 26, which are devised with respect to the shape and position to urge ventilation inside the mask without reducing the shock resistance of the mask and hindering the field of view of the wearer.

Said vent holes 27, ventilating windows 29 and the clearance 32 improve ventilation between the interior and exterior of the mask to prevent the inner surface of the protective mask 23 from fogging caused by the breath and perspiration of the wearer.

To the flange-shaped outer periphery 25 of said protective mask 23 is secured fixedly a peripheral face cover 30 formed of a rubber or synthetic resin material having high resiliency and smooth roundness on the outer peripheral surface to prevent an attacking unarmed hand of opponent from injuries being injured and the peripheral surface of the mask from being cracked by the blows of a hard rod or the like. Also, this peripheral cover 30 functions to improve the fixation and conformance between the protective mask 32 and the front cover 12.

In the embodiment shown in FIGS. 1–3, the cover body 11 is formed of a resilient member formed into a predetermined shape and coating 31 consisting of synthetic resin paint or the like having high flexibility, expansibility, water proof, anti-wear property, etc. and coated on the front and rear surfaces of the formed cover body. This coating is obtained from immersing the cover body 11 into melted resin or applying the resin on the cover body 11.

Such a coating 31 improves the water-proof of the cover body 11, provides a hygienic cover body 11 that will not absorb perspiration of the wearer, protects the appearance of the cover body from stains and further effectively protects the interior cushion members from lacerations or the like. Coatings 31 may be formed also of leather or synthetic leather bonded together.

Figure 5:
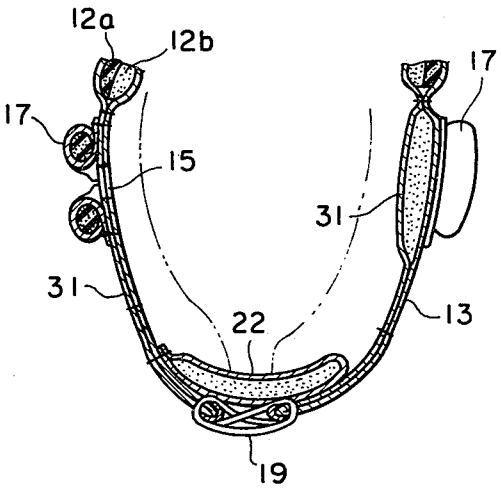
FIG. 5 is a partially sectional view viewed from above of the safe guard protective equipment shown in FIG. 4.
Figure 4:
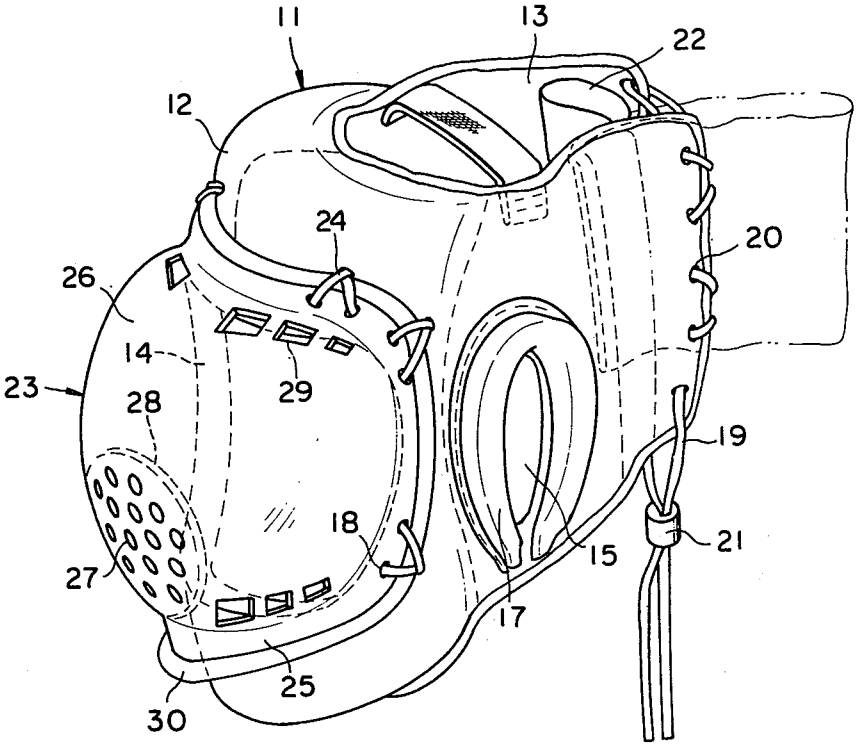
FIG. 4 is a perspective view showing the whole construction of another embodiment of the safe guard protective equipment according to the present invention.

FIGS. 4 and 5 are respectively a perspective view showing another embodiment of the safe guard protective equipment according to the present invention and a partial sectional view as viewed from above of said safe guard protective equipment. In this embodiment, only a cushion material inside the front cover 12 is formed as a single body inserted fixedly into a bag of leather or the coating 31 of synthetic leather while the cushion material is enclosed in necessary portions of said coating 31 on the side covers 13,13 at both rear sides, mainly in the periphery of the ear window 15. The construction other than that of these portions is basically same as that of the embodiment shown in FIGS. 1–3.

In either type of the embodiments shown in the above drawings, the side covers can be provided with a plurality of holes of relatively small diameter so that humidity in the interior of the protective equipment, when worn, is prevented.

What is claimed is:

1. Safe guard protective equipment for protecting a wearer engaged in the fighting arts comprising:

a cover body integrally formed with an upper front portion to cover the brow and a lower front portion to cover the chin of said wearer and side portions extending across the side and rear of said wearers head, said cover body being composed of a tough armored exterior member formed of shock-resistant material of relatively high hardness having bonded thereto a resilient lining member formed of relatively soft material having high foaming magnefication and high adaptability to the face and head;

a spherical shaped protective mask of transparent highly shock-resistant material having a flange shaped peripheral portion conforming to the shape of the front of said cover body and fixedly secured thereto, said protective mask providing a central viewing window and being formed with a thickened portion in the lower half having a plurality of small vent holes therethrough for passage of said wearer's breath and with a plurality of ventilating windows positioned in the upper and lower portions of the outer periphery so as not to affect the field of view of said wearer; and fastening means arranged at the rear ends of said cover body side portions for securing said ends about said wearers head.

2. Safe guard protective equipment as claimed in claim 1, further comprising a coating of resin paint on the entire surface of said cover body.

3. Safe guard protective equipment as claimed in claim 1, wherein the surface of said cover body is covered with leather.

4. Safe guard protective equipment as claimed in claim 1, wherein the surface of said cover body is covered with synthetic leather.

5. Safe guard protective equipment as claimed in claim 1, wherein said protective mask is shaped to provide a ventilating clearance between its lower central portion and the lower front portion of said cover body.

6. Safe guard protective equipment as claimed in claim 1, wherein said side portions of said cover body are formed with an ear window having disposed along its periphery an ear cover of cushion material.

7. Safe guard protective equipment as claimed in clim 1, wherein said flange shaped peripheral portion of said protective mask is covered by a resilient cover to avoid injury to an attacker.

8. Safe guard protective equipment as claimed in claim 1, wherein said protective mask is secured to said cover body by means of a string passing through holes in said mask and said body.

* * * * *